United States Patent [19]

Morin

[11] Patent Number: 4,867,143

[45] Date of Patent: Sep. 19, 1989

[54] TILTABLE RECLINING BOARD DEVICE FOR USE IN PROVIDING PHYSICAL THERAPY

[75] Inventor: Hans Morin, Åkers Styckebruk, Sweden

[73] Assignee: Svenska Rehabiliteringsprodukter AB, Strängnäs, Sweden

[21] Appl. No.: 103,197

[22] Filed: Oct. 1, 1987

[51] Int. Cl.[4] ..... A63B 17/00

[52] U.S. Cl. ..... 128/75; 272/144; 272/145

[58] Field of Search ..... 128/70–75, 128/69, 80 R; 272/72, 117, 118, 144, 145; 269/323–328

[56] References Cited

U.S. PATENT DOCUMENTS

| | | | |
|---|---|---|---|
| 1,693,810 | 12/1928 | Daniels | 128/70 |
| 2,714,507 | 8/1955 | Goodrich | 272/72 |
| 4,153,244 | 5/1979 | Tauber | 272/123 |
| 4,494,532 | 1/1965 | Masuda | 128/71 |
| 4,531,731 | 7/1985 | Law | 128/71 |
| 4,541,627 | 9/1985 | MacLean | 272/72 |
| 4,546,972 | 10/1985 | Goyer | 272/144 |
| 4,609,193 | 9/1986 | Paris | 272/145 |
| 4,717,148 | 1/1988 | Brewer | 272/145 |

FOREIGN PATENT DOCUMENTS

| | | | |
|---|---|---|---|
| 2403089 | 5/1979 | France | 272/72 |
| 0858821 | 8/1981 | U.S.S.R. | 128/71 |

*Primary Examiner*—Edgar S. Burr
*Assistant Examiner*—Huong Q. Pham
*Attorney, Agent, or Firm*—Cushman, Darby & Cushman

[57] ABSTRACT

A device for treatment of back trouble by means of so-called traction and also for general well-being in another way, e.g. by improving the circulation of the blood including a stand supporting a reclining board. The reclining board can be turned about a substantially horizontal. The device further includes a foot plate which can also be turned about the horizontal axis at a definite distance from the reclining board. The reclining board is supported by a frame connected to the stand at the horizontal axis and the reclining board is arranged to be movable in its longitudinal direction relative to the frame, preferably in such a way that the reclining board is running on the frame, on wheels

8 Claims, 3 Drawing Sheets

TILTABLE RECLINING BOARD DEVICE FOR USE IN PROVIDING PHYSICAL THERAPY

BACKGROUND OF THE INVENTION

This invention relates to a device for treatment of back pains and also for general well-being in another way, for instance by improving the circulation of the blood, comprising a stand supporting a reclining board which can be turned about a substantially horizontal shaft and a foot plate which can also be turned about the horizontal shaft at an adjustable distance from the reclining board.

Devices of the above-mentioned type are previously known. In using a typical one of these prior art devices, the person to be treated (assuming, for sake of convenience in description that the person is a man) places himself with his feet on the foot plate and fastens his feet to foot plate. After that he leans backwards with the upper part of his body against the reclining board and thereby presses the reclining board backwards, the suspension of the reclining board in the stand being such that the person's centre of gravity inclusive of reclining board and foot plate will shift so as to become located on the other side of the horizontal rotational shaft relative to the foot plate, so that the reclining board with the person is turned around the horizontal rotational shaft. Usually there is some kind of restriction so that the reclining board will not be quite turned completely over and the person have his head pointing straight downwards. However, the intention is that the person should lie substantially hanging by his feet, in order to achieve stretching of his back by his own body weight, so-called traction.

However, one disadvantage of these known devices is that the person's backward inclination must be rather great in order to overcome the friction between his body and the reclining board to obtain any stretching of his back. However, such a strong backward inclination leads in many cases to a feeling of discomfort for the person to be treated.

SUMMARY OF THE INVENTION

One object of this invention is to improve a device of the type mentioned above so that stretching of the person's back can be obtained already at a slight angle of inclination.

Another object of the invention is to create a possibility of adjusting the reclining board to provide different angles of inclination.

A further object of the invention is to provide a device of the type mentioned above which is easily collapsible to reduce its need of space when the device not used.

BRIEF DESCRIPTION OF THE DRAWINGS

The invention is now described in greater detail in the form of a non-restrictive illustrative example shown on the accompanying drawings, wherein.

DETAILED DESCRIPTION

Figure 1:
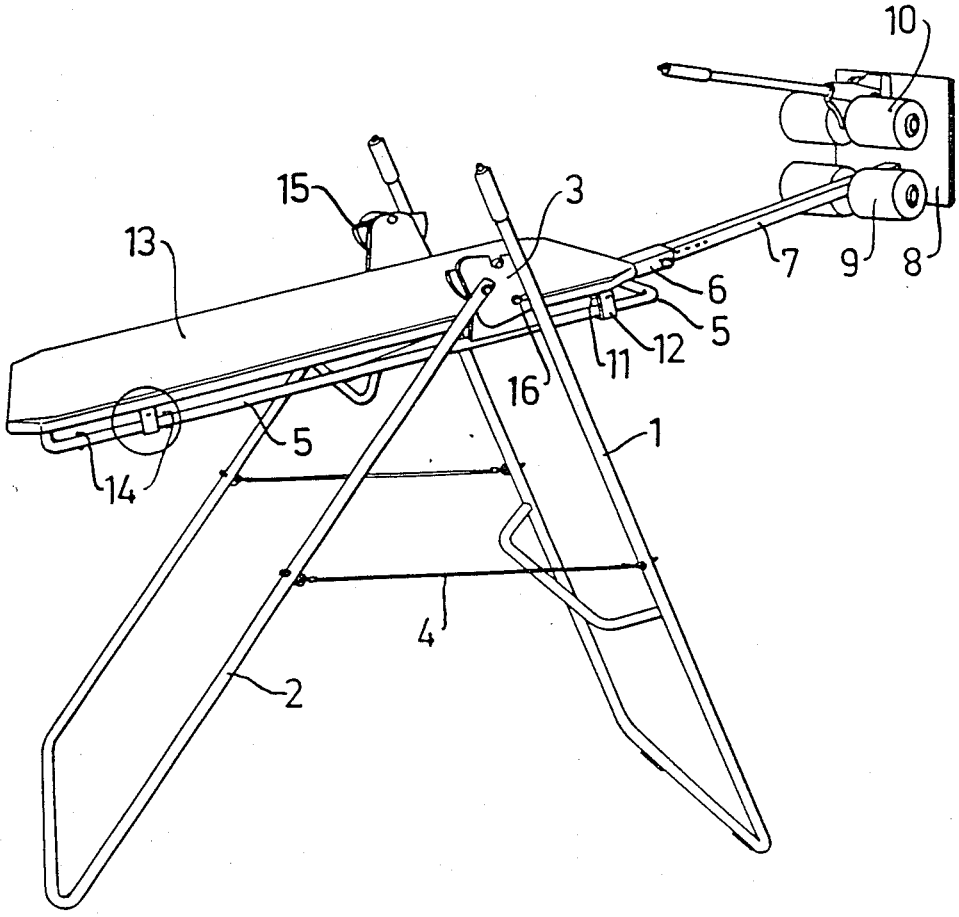
FIG. 1 is a perspective view of an embodiment of the device of the invention.

FIG. 1 shows a device according to the invention, which device which comprises a stand formed by two substantially U-shaped tubular stand portions 1, 2 connected with one another by means of a fastening plate 3 at each leg of the U-shaped stand portions. The fastening plates 3 are welded at some distance from the free ends of the stand portion 1 while the free end portions of the stand portion 2 are attached to the fastening plate 3, by respective horizontal axis fasteners at 25, so that they can be turned. Approximately midway along of the legs of the two stand portions 1 and 2, limiting wires or chains 4 are attached connecting the leg portions 1 and 2 with one another and preventing them from being turned apart from one another more than what is permitted by the limiting wires. In this way the stand, inclusive of the wires or chains 4, has substantially the shape of an A, as seen laterally.

A substantially rectangular frame 5, having an attachment 6 of a rod 7 supporting a foot plate 8 at one of its short ends, is rotatably attached to the fastening plate 3. On this foot plate 8, a fixed rear foot support 9 and a front adjustable foot support 10 are arranged, by means of which which the feet of a person to be treated can be clamped to the foot plate. The rod 7 supporting the foot plate is preferably provided with a plurality of holes through the rod 7 by means of which the rod can be adjusted in different positions relative to the attachment 6, by means of a pin that can be threaded through the attachment and the hole in the rod, so that the foot plate can be adjusted in different positions for adaptation to the height of the person to be treated.

Figure 2:
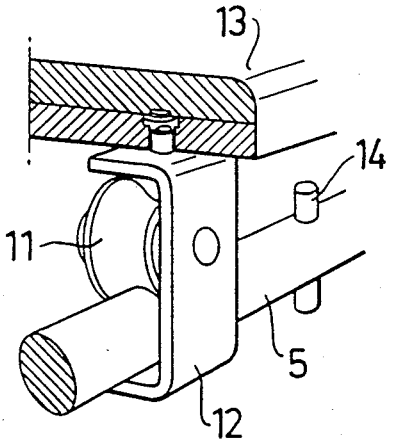
FIG. 2 shows a detail of how the reclining board of FIG. 1 is fastened.
Figure 3:
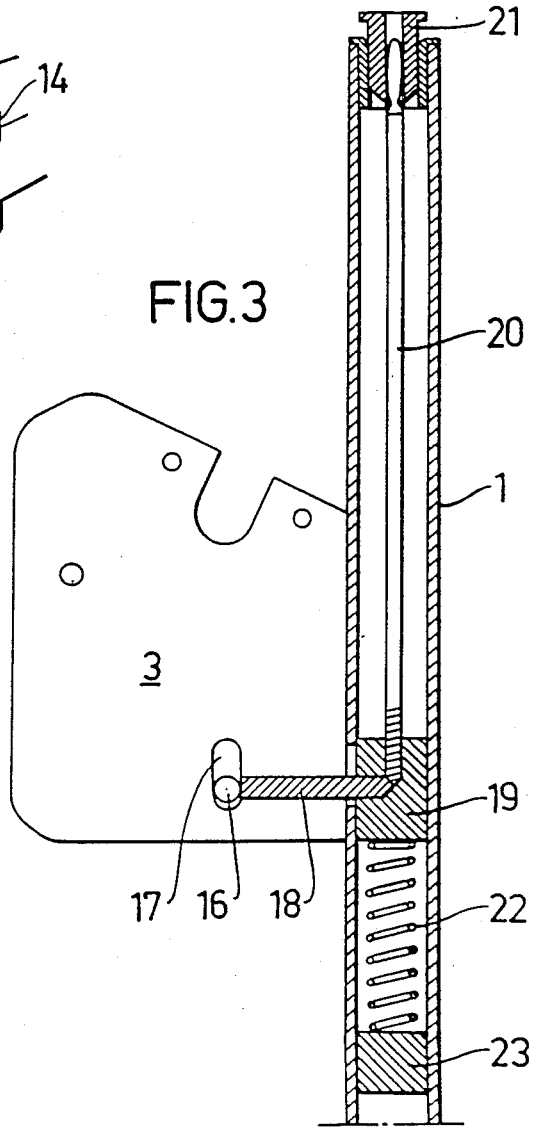
FIG. 3 shows a part of the stand of the device of FIG. 1, especially part of a locking means, partly in section.

The frame 5 rotatably mounted to the following plate 3, as is apparent from FIG. 2, consists preferably of a rod having a substantially circular cross-section. A plurality of wheels 11 is arranged to run on this frame, which wheels are mounted in attaching members 12. As is apparent from FIG. 2, the wheels are preferably made as guide wheels, each having a concave tread so that it can roll easily on the convex surface of the frame. The attaching members 12 support, in turn, the reclining board 13 on which the person being treated has the main portion of his body located during the treatment. The frame is further provided with stop means 14 located at some distance from each other, on both sides of at least one of the wheels 11, to restrict its motion on the frame 5. In this way, the reclining board 13 will be supported so that it is easily movable in its longitudinal direction relative to the frame 5.

In order to limit the turning of the frame 5, and, consequently, the reclining board 13 about the point of suspension (i.e., the transverse, horizontal axis 26) in the fastening plates 3 there is arranged a locking means. This locking means comprises a notched locking disc 15 shown in FIG. 4, which is attached, by respective transverse, horizontal pivot pins on the axis 26, to the flanges 27 fixing the frame 5 to the fastening plate 3. As is apparent from the figures, this locking disc preferably has a notched substantially semi-circular perimetrical working edge profile. The locking means further comprises a locking pin 16 that can engage the teeth of the locking disc 15 and is guided in an elongate hole 17 in the fastening plate 3 and movable in radial direction relative to the locking disc. The locking pin 16 is rigidly connected by means of a short rod 18 extending from the locking pin into an elongate opening in the tubular stand portion 1, within which the short rod 18 is connected in a sliding member 19 to a longer rod 20 extending in parallel with the stand portion 1 and substantially from the sliding member 19 up to the upper free end of the frame portion 1. The longer rod 20 is there connected to a pressure regulator 21, by means of which the longer rod 20, the sliding portion 19, the short rod 18 and consequently the locking pin 16 can be moved in radial direction out of respective ones of the notches 24 in the locking disc 15. Moreover, beneath the sliding member in the stand portion 1, there is arranged a compression spring 22 bearing on the sliding member 19 and a fixed stop means 23 in the frame portion. In this way, the locking pin 16 is biassed to be normally pressed into a respective notch 24 in the locking disc 15, or to be at such a distance from the centre of the locking disc that the locking pin strikes against the edge of the locking disc when the locking disc is turned around its centre.

Figure 4:
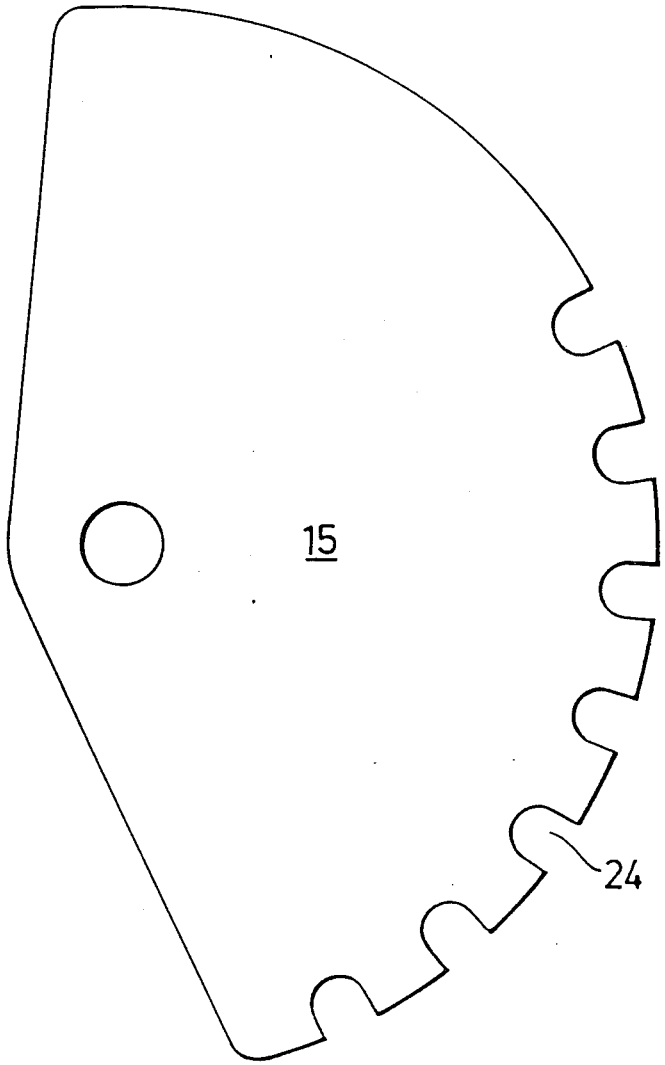
FIG. 4 shows a locking disc for use with the locking means.

The function of the device is as follows:

The stand 1, 2 is opened to the position shown in FIG. 1 and the person who is to use the device loosens the foot fastening means 10, with the reclining board 13 in a substantially vertical position (foot plate downwards), climbs onto the foot plate 8 and thereafter clamps the foot fastening means 10 so that his ankles are locked between the foot fastening means 10 and the foot support 9. (The foot plate 8 should be adjusted before this, by means of the rod 7, to such a height that the person when standing on the foot plate will get far-enough onto the reclining board 13 with the upper part of his body so that this, when the person leans against the reclining board 13, the reclining board 13 will turn about the substantially horizontal axis 24 about which the reclining board 13 is rotatably attached to the fastening plate 3 of the stand by means of the frame 5). Thus, when the person leans against the reclining board and unfastens the locking means by pressing the pressure regulator 21, the reclining board is turned with the frame to approximately the position shown in FIG. 1, in which the locking pin 16 engages the first notch 24 of the locking disc 15, the uppermost notch as shown in FIG. 4. As is apparent from FIG. 1, the reclining board 13 has only a slight downward inclination against its head end, and, at such an inclination, in case of a reclining board according to the prior art, the person lying on the reclining board should lie completely still and not be stretched at all due to the friction between the person's body and the fixed reclining board. On the contrary, with the reclining board of the invention, which is movable on the frame 5, the person's body and the reclining board will be pulled downwards and the person's body stretched, as a result, to attain the intended traction. By a new depression of the pressure regulator 21, the locking pin 16 is displaced out of the first notch 24 in the locking disc 15 and the reclining board 13, with the frame 5, is turned further, until the locking pin is pressed into the next notch in the locking disc, due to the action of the spring 22. In this way, the inclination of the reclining board can be adjusted to a plurality of, e.g. seven different positions, until, at the most extreme, the person is in a substantially vertical position, with his head downwards, to adjust the stretching degree.

As the stand 1, 2 is collapsible, because the stand portion 2 can be turned about its attachment in the fastening plate 3, in which the frame 5 with the reclining board 13 and the foot plate 8 can also be turned, the whole devices can be easily folded up to a very compact unit requiring very little space when the apparatus is not being used.

I claim:

1. A tiltable reclining board device for use in providing physical therapy, comprising:

a stand having an elevated, horizontal, transverse axis;

a longitudinally elongated frame having a first end and a second end;

a foot plate, including foot support means for supporting a user's weight when the foot support means is located at a level which is lower than said axis, and means for hangingly attaching a user to the foot plate assembly when the foot support means is located at a level which is higher than said axis;

an attachment means securing said foot plate to said frame so that said foot plate is spaced longitudinally from said frame beyond said second end of said frame;

said frame being mounted to said stand by an adjustable locking means, for pivotal movement between an upright position, in which said foot plate is located at a lower level than said axis, and an inverted position, in which said foot plate is located at a higher level than said axis;

said adjustable locking means acting between said frame and said stand for selectably fixing said frame in said upright position, in said inverted position, and in at least one reclining position angularly intermediate said upright position and said inverted position;

a longitudinally elongated reclining board for supporting a user's back while a user is inclined or reclined thereupon; stop means including a pair of stops; and means mounting said reclining board on said frame for unrestricted translational movement thereon longitudinally of the frame; limted only by said stop means, so that a user can mount the device when the frame is in an upright position, support his or feet on the foot support means, secure himself or herself to the foot plate, tilt the frame, and thereby the reclining board and the foot plate until the foot support means is located at a level which is higher than said axis, so that the weight of the user's back, applied on the reclining board causes said reclining board to move towards said first end of said frame as the user becomes at least partially hangingly supported on the device by continuing securement of the user's feet to the foot plate.

2. The device of claim 1, wherein:

said frame includes two transversally spaced, longitudinally extending frame membrs; and said mounting means includes wheels rollably mounted on said frame and constrained to run along said frame members.

3. The device of claim 2, wherein:

said frame members are externally convex in transverse cross-sectional profile; and said wheels are externally perimetricaly concave in cross-sectional profile, so as to have concave running surfaces running on said frame members.

4. The device of claim 1, wherein:

said adjustable locking means include:

at least one locking disc mounted to the frame and having a convex profile provided with a plurality of angularly spaced notches; and said stand includes a locking pin means associated with said locking disc, and pressure regulator means for projecting and retracting said locking pin means in relation to said convex profile, so that the user can retract the locking pin means from one said notch, tilt the frame to a desired extent, and project the locking pin means into another said notch to lock the frame at a desired position.

5. The device of claim 4, wherein:

said stand includes first and second stand portions which project upwardly towards one another;

means joining said first and second stand portions at an elevated level;

one of said stand portions extending above said joining mmeans to have an elevated upper end; and said pressure regulator means being partially enclosed in said one stand portion and being accessible for manual actuation at said elevated upper end.

6. The device of claim 5, wherein:

said first and second stand portions are U-shaped and extend transversally of said device;

said frame further includes limiting means extending longitudinally of said device, between said first and second stand portions, for limiting spreading of said stand portions away from one another; and said first and second stand portions being pivotally joined by said joining means, whereby said device may be collapsed into less space, for storage.

7. The device of claim 1, wherein:

said stand includes first and second stand portions which project upwardly towards one another;

means joining said first and second stand portions at an elevated level;

said first and second stand portions being U-shaped and extend transversally of said device;

said frame further including limiting means extendng longitudinally of said device, between said first and second stand portions, for limiting spreading of said stand portions away from one another;

said first and second stand portions being pivotally joined by said joining means, whereby said device may be collapsed into less space, for storage.

8. The device of claim 1, wherein:

said attachment means includes means for providing lengthwise adjustment of the longitudinal extent of said foot plate, whereby said foot plate may be disposed at a variable distance beyond said second end of said frame.

* * * * *